US006685062B1

(12) United States Patent
Ki

(10) Patent No.: US 6,685,062 B1
(45) Date of Patent: Feb. 3, 2004

(54) DISPENSER PUMP

(75) Inventor: Joong Hyun Ki, Incheon (KR)

(73) Assignee: Yon Woo Corporation, Incheon (KR)

( * ) Notice: Subject to any disclaimer, the term of this patent is extended or adjusted under 35 U.S.C. 154(b) by 0 days.

(21) Appl. No.: 10/243,692

(22) Filed: Sep. 16, 2002

(51) Int. Cl.[7] ..... B65D 88/54

(52) U.S. Cl. ..... 222/321.7; 222/321.9; 222/385

(58) Field of Search ..... 222/321.7, 321.1, 222/321.3, 321.9, 38 D, 341, 382, 385

(56) References Cited

U.S. PATENT DOCUMENTS

| | | | | | |
|---|---|---|---|---|---|
| 3,187,960 | A | * | 6/1965 | Gorman | 222/321.9 |
| 4,071,172 | A | * | 1/1978 | Balogh | 222/321.7 |
| 4,183,449 | A | * | 1/1980 | Blake | 222/321.2 |
| 4,371,097 | A | * | 2/1983 | O'Neill | 222/321.7 |
| 4,410,107 | A | * | 10/1983 | Corsette | 222/321.7 |
| 4,458,832 | A | * | 7/1984 | Corsette | 222/153.13 |
| 4,984,702 | A | * | 1/1991 | Pierpont | 215/272 |
| 5,002,207 | A | * | 3/1991 | Giuffredi | 222/340 |
| 5,335,830 | A | * | 8/1994 | Cater | 222/153.13 |
| 5,752,627 | A | * | 5/1998 | Vandromme et al. | 222/137 |
| 6,308,865 | B1 | * | 10/2001 | Lin | 222/153.13 |
| 6,415,959 | B1 | * | 7/2002 | Bougamont et al. | 222/159 |

* cited by examiner

*Primary Examiner*—Gene Mancene
*Assistant Examiner*—Frederick C. Nicolas
(74) *Attorney, Agent, or Firm*—Bacon & Thomas, PLLC

(57) ABSTRACT

The present invention relates to a dispenser pump of novel design excellent in assembling feasibility, durability and in avoidance of deterioration by the trouble from contents.

The invention is a dispenser pump comprising a screwed cap 2 connected to the opening part of a container 1, a button 3 provided vertically movably on the top of the screwed cap 3 and formed with a nozzle 4, a stem 6 connected to a lower part of the button 3 so as to communicate with the nozzle 4, a cylinder housing 10 provided with a check valve 14 in an opening part 15 at the lower end of the housing, a top part of the cylinder housing 10 being connected to the screwed cap 2, a piston 9 connected to the lower part of the stem 6 to be vertically movable in the cylinder housing 10 and a sealing member 12 provided on the circumference of the piston 9, wherein the dispenser pump includes further an upper ring member 22 fitted on the upper part of the stern 6, the position of the upper ring member being restricted by a stopper 21, and a lower ring member 24 fitted on the lower part of the stem 6 and positioned at an upper part of the piston 9, so that a spring 8 can be elastically provided between the upper ring member 22 and the lower ring member 24.

1 Claim, 3 Drawing Sheets

DISPENSER PUMP

FIELD OF THE INVENTION

The present invention relates to a dispenser pump and more particularly to a dispenser pump of novel design excellent in assembling feasibility, durability and in avoidance of deterioration by the trouble from contents.

BACKGROUND OF THE INVENTION

The conventional containers containing cosmetics, detergents and other liquid- or paste-formed contents are usually provided with dispenser pumps on their openings so as to discharge the contents in desired quantities. Referring to FIG. 1 which shows the structure of such a dispenser pump according to the conventional art, a button 3 formed with a nozzle 4 is seen as provided on the top of a screwed cap 2, which cap is screwed to the top opening part of a container 1. Under the button 3, a stem 6 and a piston 9 connected to the stem are provided so as to be moved vertically by a spring 8 housed in a cylinder housing 10. A sealing member 12 is disposed on the circumference of the piston 9. The cylinder housing 10 is provided, at its inner bottom, with a check valve 14 in the form of a ball and is provided with an opening 15 at its bottom end. The reference number 5 stands for an aluminum cap covering the exterior of the screwed cap 2, the number 16 for an over-cap and the number 18 for a gasket.

Further, another piston 20 usable for so-called airless type dispensers acts to raise the underneath contents as it rises due to the reduced pressure in the air space of the container 1.

Thus, upon pressing the button 3, the stem 6 with the piston 9 is lowered against the elastic force of the spring 8 to cause the contents in the cylinder housing 10 to be flowed up along the channel formed inside the stem 6 before being ejected through the nozzle 4, with the check valve 14 simultaneously blocking the lower end of the cylinder housing 10. On the contrary, when the button 3 is released, the check valve 14 is opened due to the reduced pressure on the side of the cylinder housing 10 as the stem 6 together with the piston 9 are moved up by the elastic force of the spring 8, so that the contents in the container 1 may be flowed in the cylinder housing 10.

Incidentally, in this type of conventional dispenser pumps as shown in FIG. 1, fluid contents such as cosmetics come in contact with the spring 8 made of a metal like steel, because the spring 8 is located inside the cylinder housing 10 under such an overall arrangement. Thus, there is caused a problem in that the spring 8 gets rusted, deteriorating the quality of the contents coming in contact with the spring 8.

To overcome this problem, a dispenser pump was proposed to avoid the contents from directly contacting the metal spring 8, by locating the spring 8, instead of the inside of the cylinder housing 10, between the internal bottom surface of the button 3 and the top surface of a screw cap 2, as shown in FIG. 2. With this dispenser pump, however, in the assembling step, the number of assemblies to be assembled is relatively large, because three sets of assembling units, i.e. the assembly including a stem 6 and a piston 9, the assembly including a cylinder housing 10 and a check valve 14 and the spring 8 are required. This results in the complicated assembling process and wider assembling space. Even in the case of assembling with an automatic equipment, there is still the problem of complication in the respect of material feeding devices and assembling devices, also because of the many parts to be assembled. In addition, a further problem may be caused, because the button 3 tends to disengage easily from the stem 6 due to the pressing force of the spring 8, as the button 3 driving-fitted on the stem 6 gets loose with time, as the spring 8 is elastically pressed directly against the bottom surface of the button 3.

SUMMARY OF THE INVENTION

The present invention, which is devised in the consideration of the problems with conventional dispenser pumps as described above, is designed to provide a dispenser pump of novel construction, wherein the metallic spring of the dispenser pump does not come in direct contact with the contents to protect the spring against corrosion and the contents against deteriorative change, and on the other hand, both the assembling process and the construction of an automatic assembling device can be simplified due to the reduced auxiliary assemblies in the assembling step. Further, the present invention is also intended to provide a dispenser pump of novel construction excellent in durability by securing against the disengagement of the button from the stem by the elastic force of the spring.

Therefore, according to an aspect of the present invention, there is provided a dispenser pump comprising a screwed cap 2 connected to the opening part of a container 1, a button 3 provided vertically movably on the top of the screwed cap 3 and formed with a nozzle 4, a stem 6 connected to a lower part of the button 3 so as to communicate with the nozzle 4, a cylinder housing 10 provided with a check valve 14 in an opening part 15 at the lower end of the housing, a top part of the cylinder housing 10 being connected to the screwed cap 2, a piston 9 connected to the lower part of the stem 6 to be vertically movable in the cylinder housing 10 and a sealing member 12 provided on the circumference of the piston 9, wherein the dispenser pump includes further an upper ring member 22 fitted on the upper part of the stem 6, the position of the upper ring member being restricted by a stopper 21, and a lower ring member 24 fitted on the lower part of the stem 6 and positioned at an upper part of the piston 9, so that a spring 8 can be elastically provided between the upper ring member 22 and the lower ring member 24.

BRIEF DESCRIPTION O THE DRAWINGS

DETAILED DESCRIPTION OF THE INVENTION

Figure 1:
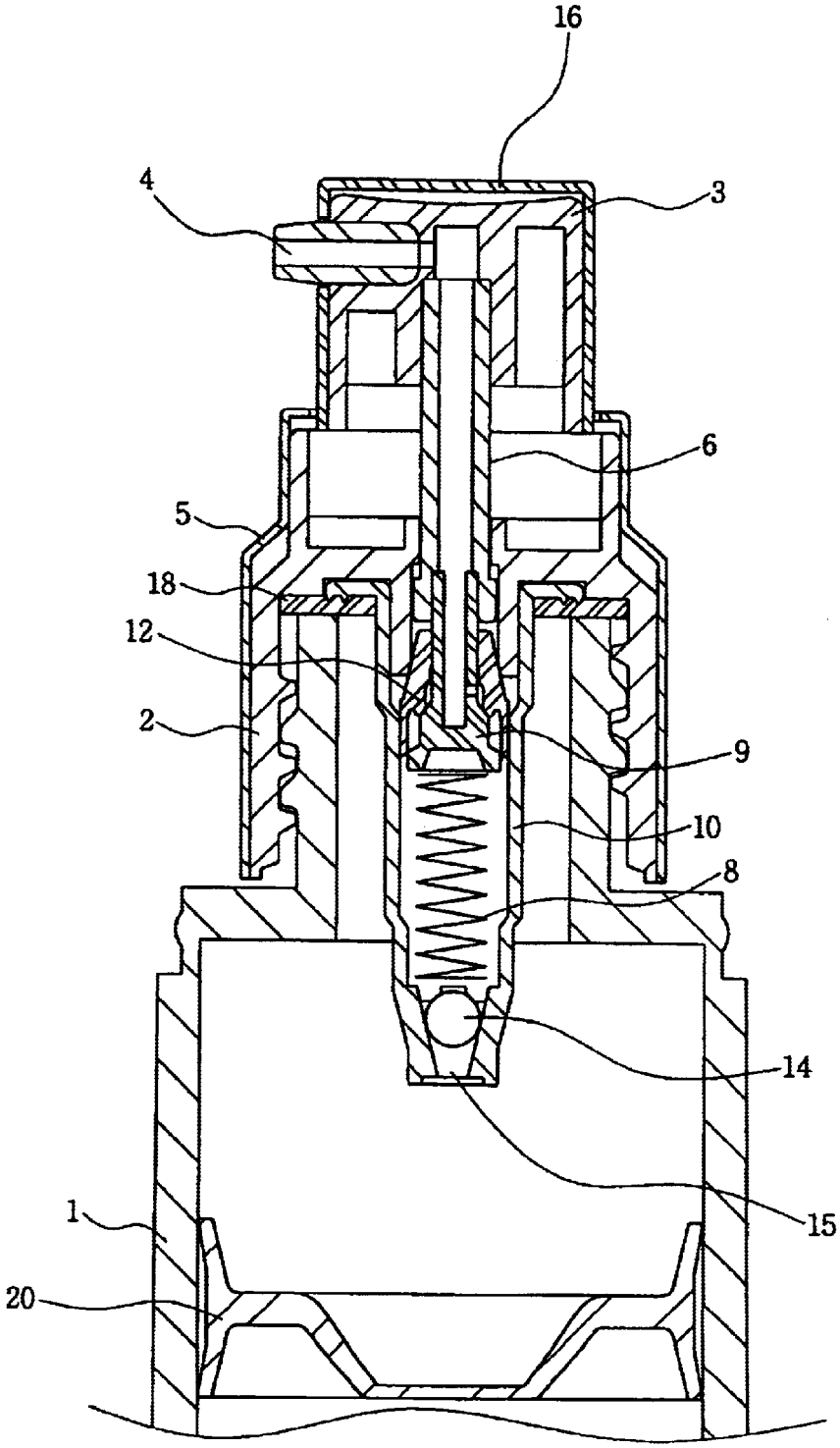
Fig. 1 PRIOR ART
FIG. 1 and 2 show the section of the conventional dispenser pump
Figure 2:
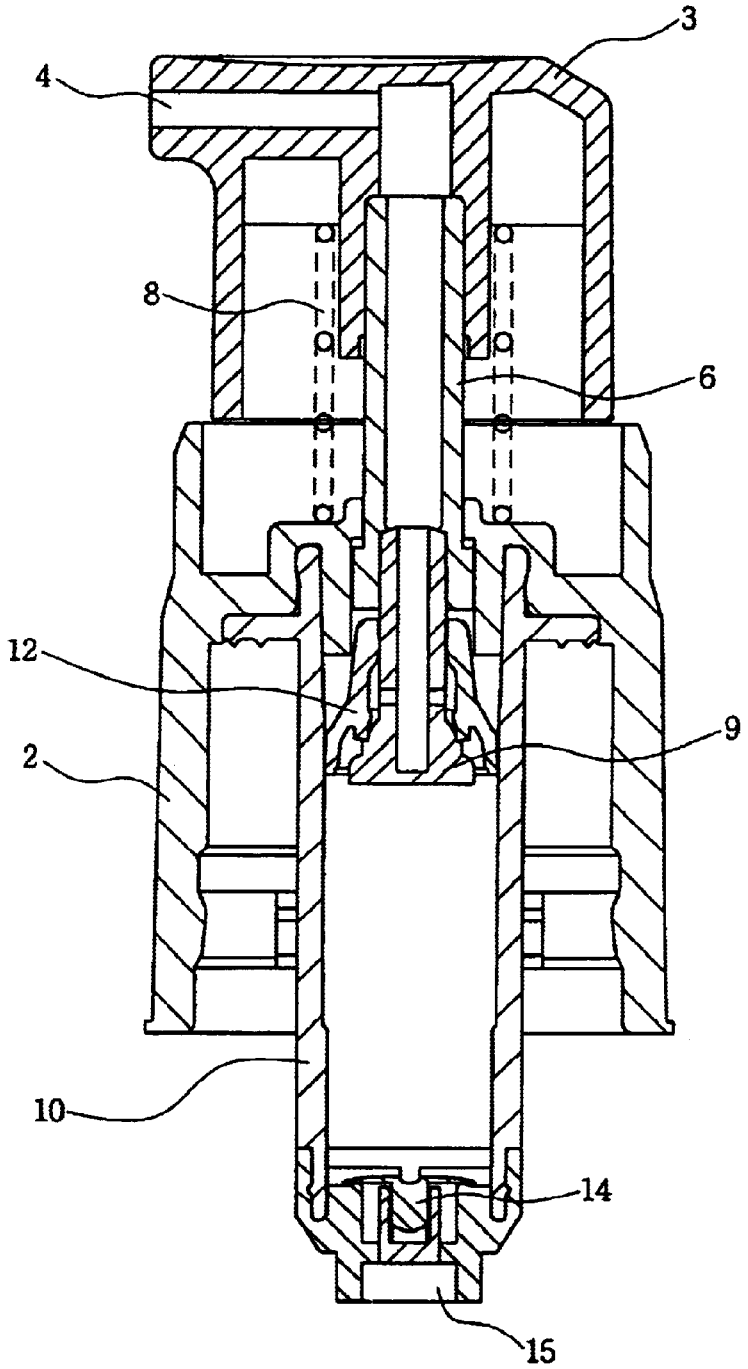
Fig. 2 PRIOR ART
Figure 3:
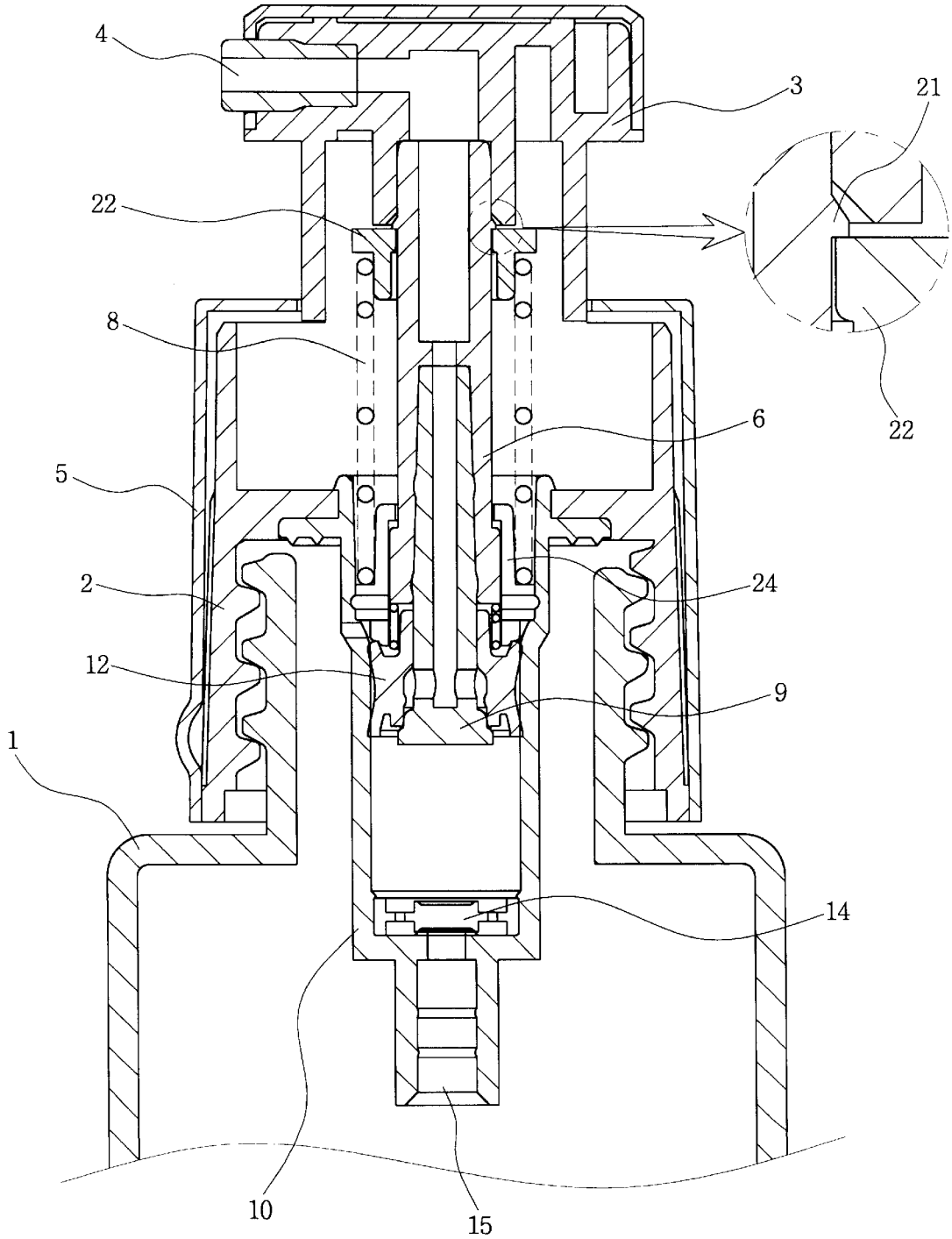
FIG. 3 shows the section of the embodiment according to the invention

A preferred embodiment of the invention is described in detail below by referring to the accompanying drawing. As can be seen from FIG. 3, which shows the arrangement of the present embodiment, the inventive dispenser pump corresponds to the conventional counterpart up to the point that a screwed cap 2 connected to the opening part of a container 1, a button 3 provided vertically movably on the top of the screwed cap 3 and formed with a nozzle 4, a stem 6 connected to a lower part of the button 3 so as to communicate with the nozzle 4, a cylinder housing 10 provided with a check valve 14 in an opening part 15 at the lower end of the housing, a top part of the cylinder housing 10 being connected to the screwed cap 2, a piston 9 connected to the lower part of the stem 6 to be vertically movable in the cylinder housing 10 and a sealing member 12 provided on the circumference of the piston 9 are included. However, in the present invention, the metallic spring 8 for lifting the button 3 elastically is provided around the stem 6 externally of the cylinder housing 10. Particularly, the spring 8 is provided elastically between an upper ring member 22 fitted on the stem 6 at its upper location and a lower ring member 24 fitted on the stem 6 at a location down the stem 6 and up the piston 9.

The upper ring member 22 is interfered with a stopper 21 in a ring form protrudent from the external surface of the stem 6, so that its top position is restricted. As the top surface of the stopper 21 is inclined downward, the upper ring 22 and the lower ring 24 can be driving-fitted on the stem 6, starting from the top end of the stem at the assembling step. The upper and lower ring members 22 and 24 are each provided with an engaging projection to receive the spring 8 between the projections. At the step of assembling, the lower ring member 24, spring 8 and upper ring member 22 are, in that order, fitted on the stem 6 from the upper end of the stem 6. At that time, the lower ring member 24 and the upper ring member 22 are forcefully pressed down along the sloped surface of the stopper 21.

In operation, when the button 3 is pressed by a user, the button 3 together with the stem 6 is lowered and the piston 9 under the stem 6 causes the contents existing in the cylinder housing 10 to be under pressure, with the check valve 14 closed, so as to be ejected through the channel and hollow cavity formed in the stem 6 and finally through the nozzle 4 to the outside, the spring 8 being compressed. Subsequently, releasing the button 3 causes the button 3 with the stem 6 to be raised due to the restoring elasticity of the spring 8, resulting in the reduced pressure in the cylinder housing 10, whereby the check valve 14 is opened to suck up the contents in the container into the cylinder housing 10.

It is to be noted that the spring 8 is prevented from direct contact with the contents of the container to protect the spring against corrosion and the contents against any deterioration because the metallic spring 8 is positioned outside the cylinder housing 10. In addition, the construction according to the invention achieves reduction in the number of sub-assemblies of the dispenser pump to be just two. Specifically, the spring 8 is incorporated in the assembly comprising the stem 6 and piston 9, as it is already provided between the upper and lower ring member 22 and 24 before the main assembling step. Thus, the dispenser pump needs this stem sub-assembly and the cylinder housing sub-assembly for complete fabrication. As this result, the assembling process becomes simplified including reduced assembling space and at the same time, the automatic assembling apparatus can be accordingly constructed in a simpler manner. Furthermore, the combination of the ring members 22 and 24 and stopper 21 achieves avoidance of elastic contact of the spring 8 directly with the bottom surface of the button 3, so that the button 3 fitted on the top of the stem 6 can be prevented from disengagement with the stem 6 to thereby increase the durability of the product dispenser pump.

As described above, according to the invention, the spring is prevented from direct contact with the contents of the container so as to protect the contents against any deterioration and the metal spring against corrosion because the spring is positioned outside the cylinder housing, and at the same time, the spring can be handled as part of the stem assembly, instead of an independent assembly, so as to reduce the number of assemblies, whereby the assembling process becomes simplified and the automatic assembling apparatus can also be constructed in a simpler manner. Furthermore, the direct contact of the spring with the bottom surface of the button is avoided, so that the button fitted on the top of the stem can be prevented from disengagement with the stem to thereby increase the durability of the product dispenser pump.

What is claimed is:

1. A dispenser pump comprising a screwed cap 2 connected to the opening part of a container 1, a button 3 provided vertically movably on the top of the screwed cap 3 and formed with a nozzle 4, a stem 6 connected to a lower part of the button 3 so as to communicate with the nozzle 4, a cylinder housing 10 provided with a check valve 14 in an opening part 15 at the lower end of the housing, a top part of the cylinder housing 10 being connected to the screwed cap 2, a piston 9 connected to the lower part of the stem 6 to be vertically movable in the cylinder housing 10 and a sealing member 12 provided on the circumference of the piston 9, wherein the dispenser pump includes further an upper ring member 22 fitted on the upper part of the stem 6, the position of the upper ring member being restricted by a stopper 21, and a lower ring member 24 fitted on the lower part of the stem 6 and positioned at an upper part of the piston 9, so that a spring 8 can be elastically provided between the upper ring member 22 and the lower ring member 24.

* * * * *